US011780074B2

(12) United States Patent
Wong

(10) Patent No.: US 11,780,074 B2
(45) Date of Patent: Oct. 10, 2023

(54) HEX KEY TOOL HOLDER

(71) Applicant: Elliott Ian Wong, Alhambra, CA (US)

(72) Inventor: Elliott Ian Wong, Alhambra, CA (US)

( * ) Notice: Subject to any disclaimer, the term of this patent is extended or adjusted under 35 U.S.C. 154(b) by 10 days.

(21) Appl. No.: 17/331,541

(22) Filed: May 26, 2021

(65) Prior Publication Data

US 2022/0379460 A1 Dec. 1, 2022

(51) Int. Cl.
*B25H 3/00* (2006.01)

(52) U.S. Cl.
CPC ..... *B25H 3/003* (2013.01)

(58) Field of Classification Search
CPC ..... B65D 25/102; B25B 15/008; B25B 13/56; B25B 21/00; B25B 23/0007; B25B 3/003; B25B 15/0004; B25B 15/007; B25B 21/12; B25B 11/002; B25B 21/007; B25H 3/003; B25H 3/00; B25H 3/04; B25H 3/06; B25H 3/022; B25H 5/00; B25H 15/008; B25G 1/085
USPC ..... 206/377, 372, 443, 379, 350, 818; 81/177.4, 490; 211/70.6, 163, 60.1, 70
See application file for complete search history.

(56) References Cited

U.S. PATENT DOCUMENTS 2,604,211 A * 7/1952 Steine ..... B25B 13/56 248/512
2,633,768 A * 4/1953 Saxby ..... B25B 13/56 81/440
RE23,659 E * 5/1953 Steine ..... B25B 13/56 211/69
2,672,777 A * 3/1954 Dossie ..... B25B 13/56 81/436
2,810,472 A * 10/1957 Midkiff ..... B25B 13/56 206/377
3,727,771 A * 4/1973 Hoffman ..... B25H 3/003 D8/71
4,043,230 A * 8/1977 Scrivens ..... B25B 13/56 81/439
4,767,006 A * 8/1988 Wasem ..... B25B 13/56 7/167
5,394,984 A * 3/1995 Aiba ..... B25B 15/008 206/372
5,662,013 A * 9/1997 Lin ..... B25G 1/085 81/177.4
5,992,625 A * 11/1999 Loiselle ..... B25B 15/008 206/443
6,237,451 B1 * 5/2001 Wei ..... B25H 3/003 81/177.4
6,508,156 B1 * 1/2003 Wei ..... B25G 1/085 81/177.4
7,073,417 B2 * 7/2006 Beauchamp ..... B25F 5/029 81/177.4

(Continued)

*Primary Examiner* — Steven A. Reynolds
*Assistant Examiner* — Prince Pal
(74) *Attorney, Agent, or Firm* — E J Asbury III, LLC

(57) ABSTRACT

A hex key holder for storing a selection of hex keys in an organized manner while allowing easy access to the individual hex keys. The hex key holder provides a ready means to affix the hex key caddy to a surface via magnets. The magnetic bond allowing convenient positioning and allowing hex keys to be easily inserted or removed from the hex holder with a single hand. The hex key holder is configured for ease of manufacture in high volumes. The magnets provide a ready means to positively affix the key holder onto a horizontal surface, vertical surface, or other angled surface.

23 Claims, 7 Drawing Sheets

(56) References Cited

U.S. PATENT DOCUMENTS 7,073,418 B2 * 7/2006 Kuo ..... B25G 1/08 81/177.2
7,389,870 B2 * 6/2008 Slappay ..... B25H 5/00 206/305
8,147,778 B2 * 4/2012 Pedrazzini ..... B01L 9/06 422/65
8,245,607 B2 * 8/2012 Kozak ..... B25G 1/085 81/177.4
8,350,663 B1 * 1/2013 Michael ..... B23Q 3/1546 338/288
8,469,188 B1 * 6/2013 Vitale ..... B25H 3/00 206/277
8,474,615 B2 * 7/2013 Kernodle, Jr. ..... B25H 3/003 206/349
8,777,005 B2 * 7/2014 Lai ..... B25H 3/003 206/377
9,102,041 B2 * 8/2015 Chen ..... B25B 13/56
9,463,568 B2 * 10/2016 Chen ..... B25G 1/043
10,041,965 B2 * 8/2018 Pedrazzini ..... B01L 9/06
2003/0136234 A1 * 7/2003 Cunningham ..... B25G 1/066 81/177.4
2004/0060838 A1 * 4/2004 Yu ..... B25G 1/085 206/349
2004/0163983 A1 * 8/2004 Chang ..... B25H 3/003 206/443
2006/0162508 A1 * 7/2006 Liu ..... B25G 1/085 81/439
2007/0023307 A1 * 2/2007 Liu ..... B25H 3/003 206/372
2009/0152150 A1 * 6/2009 Kernodle, Jr. ..... B25H 3/003 206/379
2009/0183608 A1 * 7/2009 Johnson ..... B25G 1/066 81/177.4
2009/0266731 A1 * 10/2009 Johnson ..... H04L 63/20 206/375
2012/0295457 A1 * 11/2012 Holland ..... H01R 13/447 439/142
2013/0228539 A1 * 9/2013 Lin ..... B25H 3/003 211/70.6
2014/0151253 A1 * 6/2014 Lai ..... B25H 3/003 206/377
2015/0158154 A1 * 6/2015 Chen ..... B25F 1/00 206/377
2015/0196996 A1 * 7/2015 Nelson ..... B25B 23/12 81/438
2016/0114475 A1 * 4/2016 Tang ..... B25H 3/003 206/372
2016/0368133 A1 * 12/2016 Welfel ..... B25H 3/06
2019/0015966 A1 * 1/2019 Nordness ..... B25H 3/003
2020/0316485 A1 * 10/2020 Haughey ..... E05C 19/16

* cited by examiner

-- Prior Art --

-- Prior Art --

HEX KEY TOOL HOLDER

BACKGROUND OF THE INVENTION

1. Field of the Invention

The present invention generally relates to apparatuses for tool storage. More particularly, the present invention relates to a tool caddy for hex keys wherein the hex keys are readily selectable, removed and inserted.

2. Description of the Related Art

A hex key is a simple tool used to drive bolts and screws with hexagonal sockets in their heads. The hex key forms the male part of the connection and the female recess is formed into the bolt, screw, stud, or other fastener.

The tool is usually formed from a single piece of hexagonal rod of hard steel. The tool typically has blunt ends that are meant to fit snugly into the screw's socket. Each hex key is bent in an "L" shape with unequal arms. The tool is usually held and twisted by the long arm, creating leverage over the fastener at the tip of the short arm. Reversing the tool lets the long arm reach screws in hard-to-reach places. Alternatively, the hex key may be a straight shank with a socket drive or hex drive at one end and the length of the key increasing with the size of the hex key.

Each key is meant to be used with fasteners having a standard specific socket recess size. Hex keys are commonly sold in kits that include half a dozen or more keys of different sizes, typically in imperial/American dimensions or in metric dimensions. The length of each arm of the hex key increases with the size of the socket the key is designed to fit.

The organization and storage of hex keys is notoriously difficult. No convenient hook or loop is present in the tool body as in wrenches or sockets. Therefore there is no convenient to hang the hex keys for storage. Many prior art solutions consist of piling keys in a container and using a dig, grab and try method in identifying the proper key needed for the fastener presented. No advantage is taken of the increasing length with hex key size to identify the order of the key sizes.

Some prior art hex key holders are composed of a vinyl or urethane sleeve into which the hex keys slide and are retained by friction. The keys are often difficult to position within the sleeve and difficult to remove from the sleeve as the friction may vary. In the prior art key holders, the insertion and extraction force of each key may not proportionately decrease as the key size decreases. Insertion or removal of a key often requires both hands, one to hold the sleeve and one to remove the key. Moreover, these sleeve holders provide no way to hook or attach the combination of holders and assorted hex keys to a surface convenient to a user of the key set.

According, it would be advantageous to provide a hex key holder assembly to provide an ordered retention of the various size hex keys. Such a hex key holder or caddy would be easy to insert or remove the individual keys with one hand and may take advantage of the individual key lengths to visually present the key size relations. The insertion and extraction force should be proportional to each hex key size. The hex key holder or hex key caddy would also provide a ready means to affix the caddy and inserted keys onto an adjacent work surface for ready use. It is thus to such a hex key caddy that the present invention is primarily directed.

SUMMARY OF THE INVENTION

The disadvantages of the prior art are overcome by the present invention which, in one aspect, is a hex key holder having a holder body with an upper surface and a lower surface joined by a sidewall. Multiple varying size holes extend from the upper surface to the lower surface through the holder body. Each hole has a diameter that accommodates a standard hex key. A recessed channel extends into the periphery of the holder body sidewall. The recessed channel has a channel floor which intersects each of the multiple holes. An elastic element is positioned within the channel and sized to exert a contact pressure upon the recessed channel floor. At least one magnet is affixed to the holder body. When hex keys are positioned within the holder body in a hole accommodating the hex key size, the hex keys are clamped in position by the elastic element. The hex key holder may be adhered to a structural surface having ferromagnetic material by the magnet.

In another aspect, the magnet is affixed in position to the holder body adjacent the holder body lower surface. The holder body lower surface may be positioned onto a structural surface having ferromagnetic material. The magnet adhering the holder body in place to the ferromagnetic material structural surface. Multiple hex keys inserted within the holder may then be bottomed upon the ferromagnetic material structural surface. The projection of each hex key above the holder body provides a ready visual reference as to the size of the each hex key.

In another aspect, the magnet is affixed in position to the holder body adjacent the holder body sidewall. The holder body sidewall may be positioned adjacent a structural surface having ferromagnetic material. The magnet adhering the holder body in place to the ferromagnetic material structural surface. Multiple hex keys inserted within the holder may then be bottomed upon the holder body upper surface. The projection each hex key below the holder body provides a ready visual reference as to the size of the each hex key.

In other aspects of the invention, the holder body is comprised of aluminum, brass, bronze, plastic, acrylic, vinyl, urethane rubber, natural rubber, plastic, polypropylene, polyethylene, or any combination thereof or any combination thereof. The standard hex key size accommodated by each hole is marked upon the holder upper surface adjacent to each of the plurality of holes, is embossed upon the holder upper surface adjacent to each of the plurality of holes, or is engraved into the holder upper surface adjacent to each of the plurality of holes, or any combination thereof.

In another aspect of the present invention, a hex key holder having a holder body with an upper surface and a lower surface joined by a sidewall. Multiple varying size holes extend from the upper surface to the lower surface through the holder body. Each hole has a diameter that accommodates a standard hex key. The holder body is comprised of an elastic material. The diameter of each hole is capable of deforming to accept and retain a standard hex key within. At least one magnet is affixed to the holder body. When hex keys are positioned within the holder body in a hole accommodating the hex key size, the hex keys are clamped in position by the deformation of the elastic holder body material. The tool holder may be adhered to a structural surface having ferromagnetic material by the magnet.

In another aspect of the present invention, a hex key holder having a holder body with an upper surface and a lower surface joined by a sidewall. Multiple varying size holes extend from the upper surface to the lower surface through the holder body. Each hole has a diameter that accommodates a standard hex key. A recessed channel extends into the periphery of the holder body sidewall. The recessed channel has a channel floor which intersects each of the multiple holes. An elastic element is positioned within the channel and sized to exert a contact pressure upon the recessed channel floor. The plurality of holes are positioned such that the elastic element is deflected off the channel floor a distance proportional to the nominal size an inserted hex key. At least one magnet is affixed to the holder body. When hex keys are positioned within the holder body in a hole accommodating the hex key size, the hex keys are clamped in position by the elastic element with a clamping force proportional to the hex key size. The elastic element may be deflected off the channel floor a distance within the range of 10% to 70% of the nominal size an inserted hex key.

In other aspects of the invention the magnet is molded in position within the holder body, or the magnet is affixed in position to the holder body by a press fit within a recess in the holder body. The elastic material of the holder body may include plastic, vinyl, acrylic, urethane rubber, natural rubber, polypropylene, polyethylene, or any combination thereof.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The present invention provides a hex key caddy that provides a ready means to affix the hex key caddy to a surface via magnets allowing convenient positioning. The hex key caddy is configured for ease of manufacture in high volumes. The hex key caddy provides a ready means to positively affix the key caddy via magnets onto a horizontal surface, vertical surface, or other angled surface. The hex keys are then easily inserted into or removed from the hex key caddy with a single hand. The hex keys may be bottom upon the upper surface of the caddy, or upon the surface to which the hex key caddy is affixed. The force of extraction and insertion of each hex key is proportional to the size of the hex key.

Though the present invention is discussed herein particularly as it relates to a holder or caddy for 6 "six" sided hex keys, it is to be understood such discussion is intended solely to promote an understanding of the invention. As will be appreciated by those skilled in the art, the spirit and scope of the present invention has applications in many other types of mechanic, homeowner and machinist hand tools such as screwdrivers, straight hex keys, drills, nut drivers, milling cutters, reamers, taps and the like.

Figure 1:
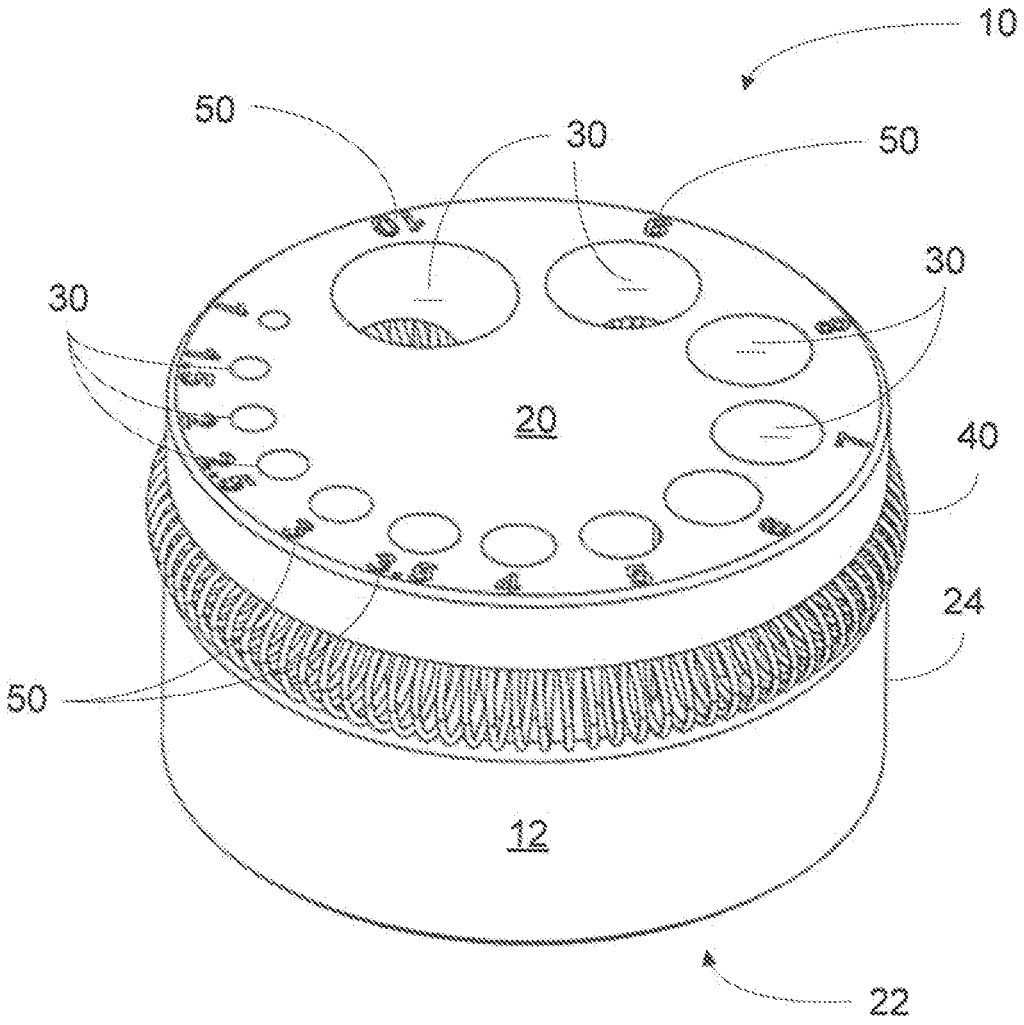
FIG. 1 is a top-perspective view of the hex key holder of the present invention.

A first embodiment of the present invention is depicted in FIG. 1. The hex key tool caddy 10 or as alternatively referred to herein, the hex key tool holder 10 has a tool holder body 12, with an upper surface 20, lower surface 22 and sidewall 24. A plurality of varying size holes 30 extend from the upper surface 20, thru the holder body 12 and out the lower surface 22. Each hole 30 corresponds to a standard hex key size. The hex key caddy holes 30 may be formed to accept imperial or metric size hex keys, or both. The hex key size accepted by each hole 30 is marked 50 adjacent each hole. As may be appreciated by those skilled in the art, the hex key size may be marked 50 by marking upon the tool holder upper surface 20, by embossing above the tool holder upper surface 20, by engraving into the tool holder upper surface 20, or by any combination thereof. Also depicted in FIG. 1 is an elastic element 40 in the form of a coil spring engaging a channel 44 in the sidewall 24 of the hex key tool holder. In other alternative embodiments, the elastic element 40 may be an elastic band of rubber, synthetic rubber, fluoropolymer elastomer, urethane, neoprene, polypropylene, polyethylene, or any combination thereof.

Figure 2:
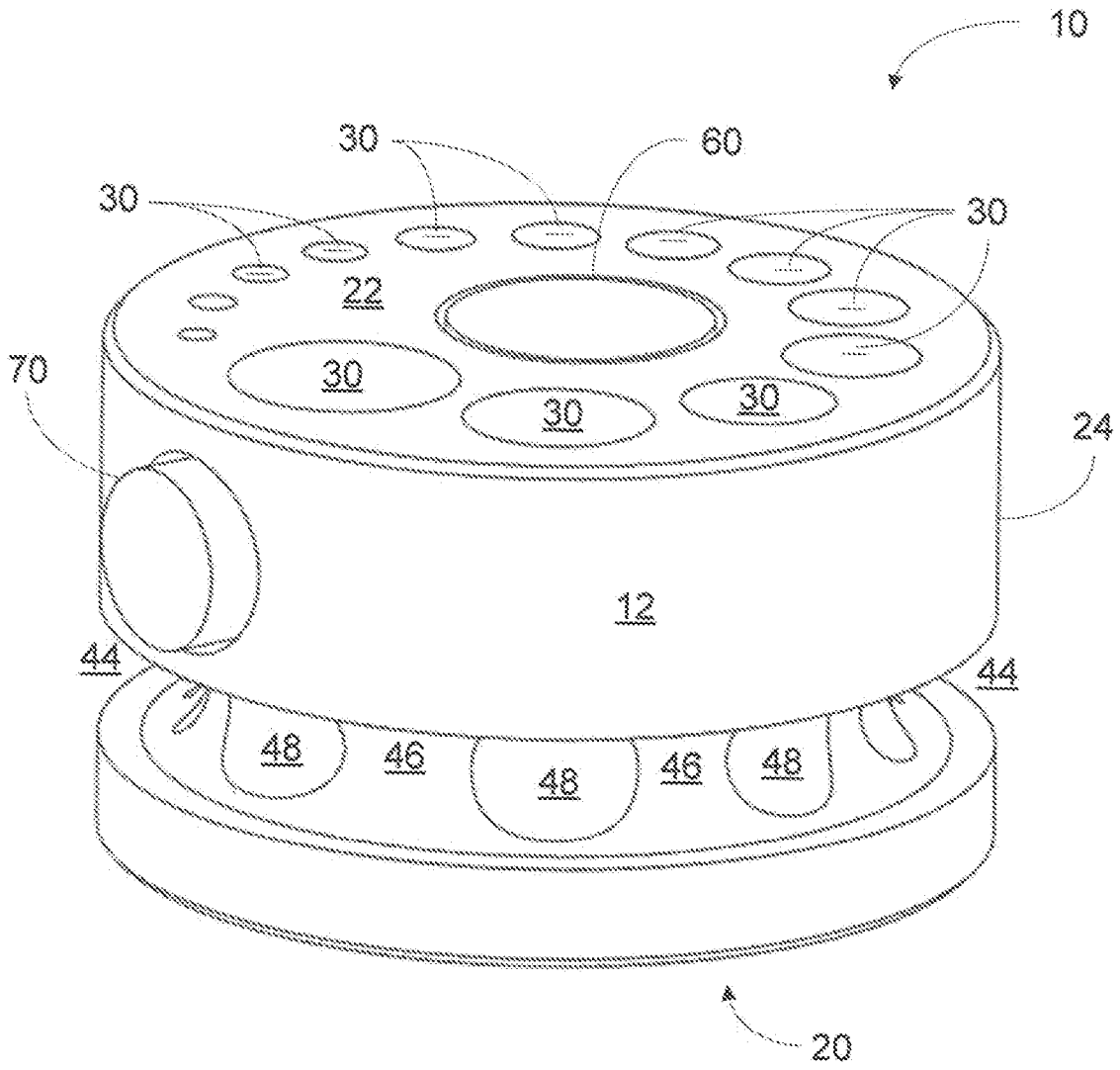
FIG. 2 is a bottom-perspective view of the hex key holder of FIG. 1.

As depicted in FIG. 2, the underside of the tool holder body 12 is depicted with lower surface 22, sidewall 24, and upper surface 20. The plurality of holes 30 extend thru the tool holder body 12 from the upper surface 20 to the lower surface 22. A channel 44 is recessed into the tool holder body 12 sidewall 24 around the periphery of the tool body 12. The channel 44 is deep enough to intersect each of the plurality of holes 30 at openings 48 in the tool body 12. The opening 48 is at the bottom of the channel 46 and allows the spring element to provide a contact pressure upon the bottom 46 of the channel 44 and to provide a contact pressure upon a hex key inserted within any corresponding hole 30.

As further depicted in FIG. 2, a magnet 60 is affixed to the tool holder body 12 adjacent the lower surface 22. In other alternative embodiments, a magnet 70 is affixed to the tool holder body 12 adjacent to the sidewall 24. As appreciated by those skilled in the art, the tool holder 10 design may have a single magnet 60, or a plurality of magnets 60. The tool holder may also have a single magnet 70 or a plurality of magnets 70. Finally, the tool holder body 12 may have any combination of magnets 60 on the lower surface 22, and any combination of magnets 70 upon the sidewall 24.

Figure 3:
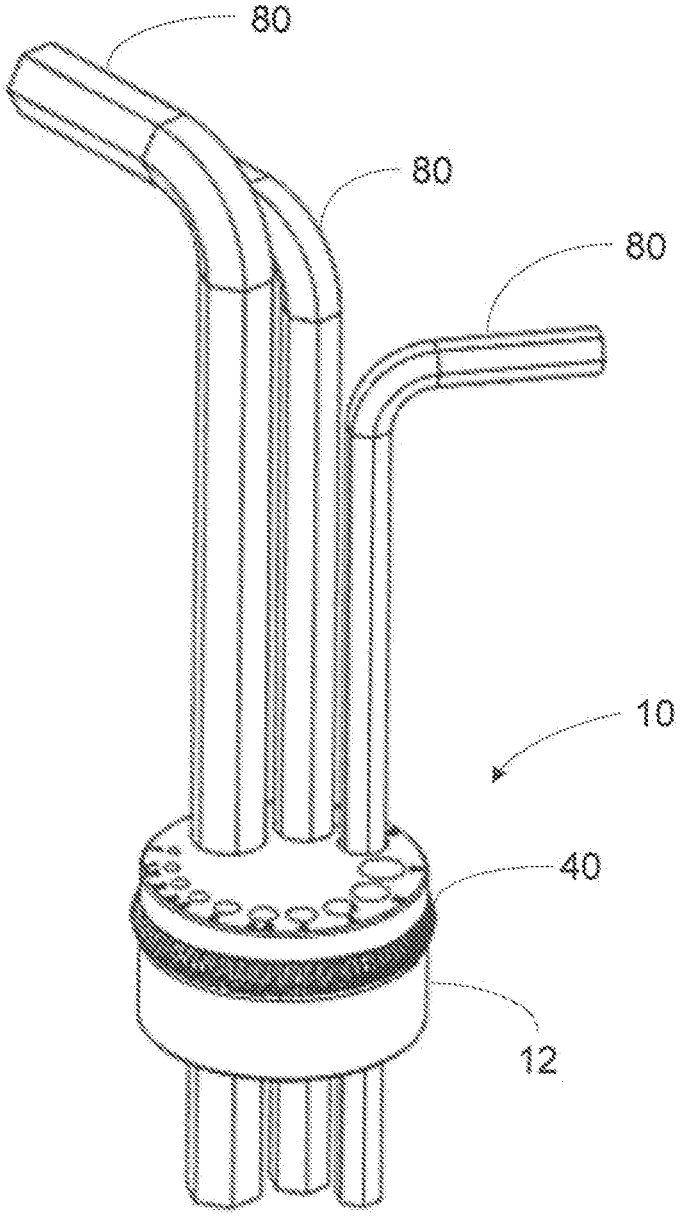
FIG. 3 is a top-perspective view of the hex key holder of the present invention with a selection of inserted keys.

As depicted in FIG. 3, a plurality of hex keys 80 are inserted into corresponding holes 30 into the tool holder 10. The hex keys 80 may be readily inserted or withdrawn into the hex key tool holder 10 in the direction of arrow "A". The coil spring 40 provides a contact pressure against the shank of each hex key 80 via opening 48 retaining the key in place. The coil spring 40 pressure retains the hex keys, but allows easy withdrawal of any hex key 80 and insertion of any hex key 80 back into the hex key tool holder 10. As depicted in FIG. 3, only three (3) hex keys 80 are shown inserted in to the holder for clarity, but any number of hex keys 80 may be inserted, including filing all holes 30 within the tool holder 10. As will be appreciated by those skilled in the art, the channel floor 46 limits the amount of spring pressure which may be applied to any hex key 80 regardless of the number of hex keys 80 inserted within the tool holder 10. Stated another way, the opening 48 provides for a consistent contact pressure from the spring element 40 against any inserted hex key 80, and bridges the spring element 40 over any opening 48 wherein a hex key 80 is not inserted.

Figure 4:
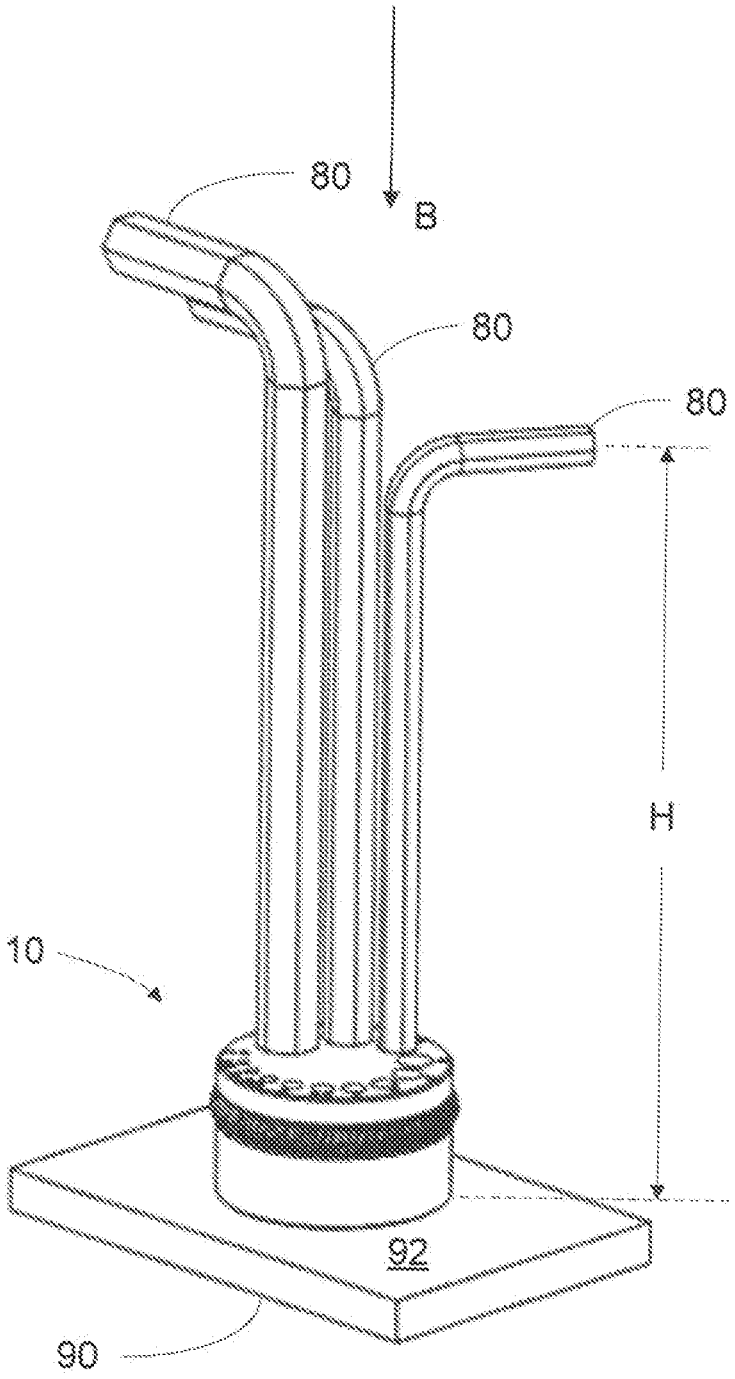
FIG. 4 is a top-perspective view of the hex key holder and keys of FIG. 3 positioned upon a horizontal surface.

As depicted in FIG. 4, the bottom surface 22 of the tool holder 10 may be positioned upon a structural surface 90. If the structural surface 90 contains ferromagnetic material, the magnet 60 will adhere the tool holder 10 in place against the face 92 of the structural surface 90. As defined herein, a "ferromagnetic material" is a material to which a magnet can be or is attracted. As further depicted in FIG. 4, the hex keys 80 may be slid within the tool holder 10 in the direction of arrow "B" to contact the face 92 of the ferromagnetic material structural surface 90. The height "H" of each hex key 80 above the face 92 then provides a ready visual reference as to the relative size of the keys 80 within the tool holder 10. As depicted herein, the structural surface 90 is horizontal, but the surface may be at any angle or inclination, and the tool holder 10 may even be adhered to the underside of a ferromagnetic material structural surface 90.

Figure 5:
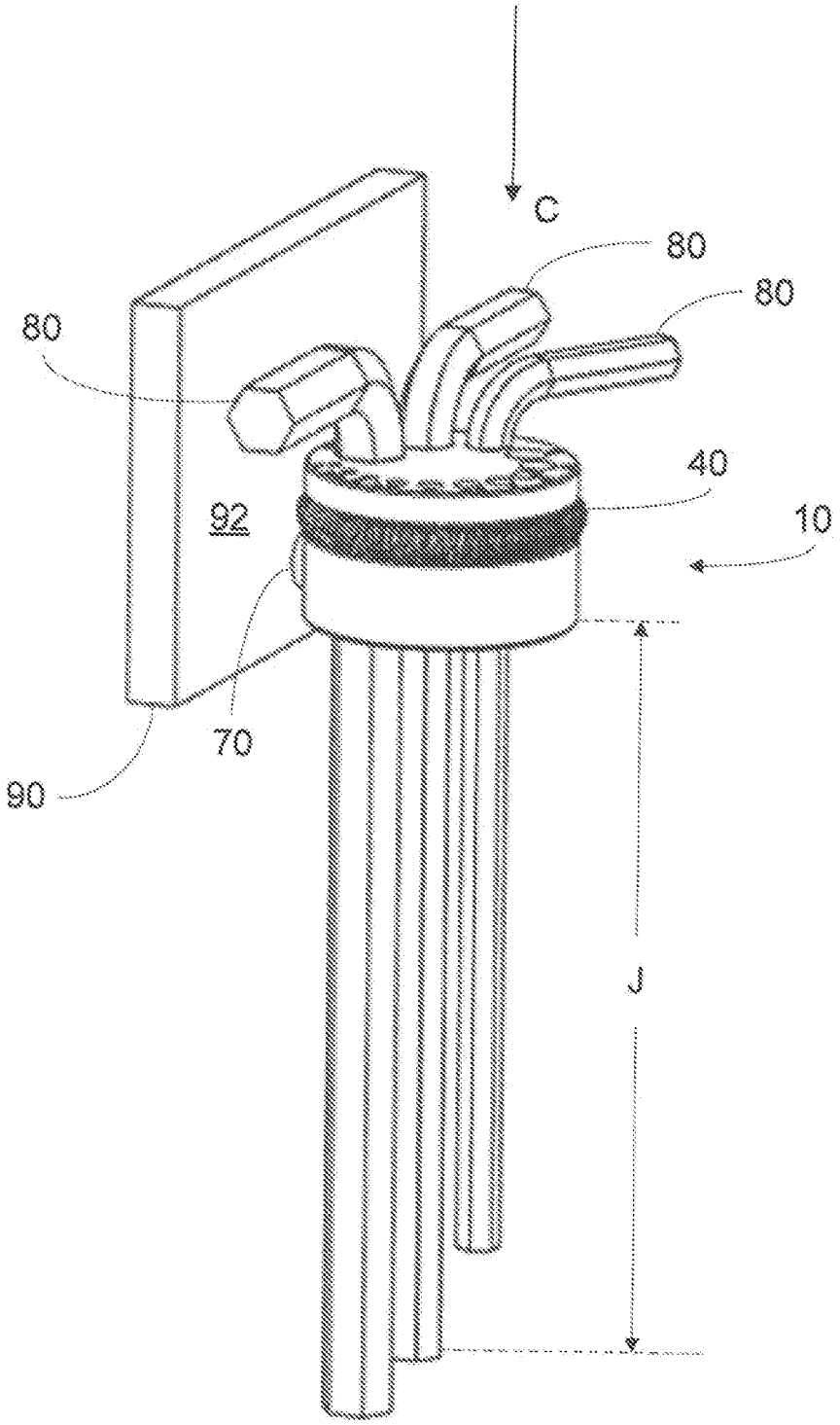
FIG. 5 is a top-perspective view of the hex key holder and keys of FIG. 3 positioned upon a vertical surface.

In another alternative embodiment as depicted in FIG. 5, the sidewall 24 of the tool holder 10 at the location of the magnet 70 may be positioned upon a structural surface 90. If the structural surface 90 contains ferromagnetic material, the magnet 70 will adhere the tool holder 10 in place against the face 92 of the structural surface 90. As further depicted in FIG. 5, the hex keys 80 may be slid within the tool holder 10 in the direction of arrow "C" to bottom against the upper surface 20 of the tool holder 10. The distance "J" of each hex key 80 below the tool holder 10 providing a ready visual reference as to the relative size of the keys 80 within the tool holder 10. As depicted herein, the structural surface 90 is vertical, but the structural surface 90 may be at any angle or inclination, and the tool holder 10 may even be adhered to the underside of a ferromagnetic material structural surface 90. As defined herein and in all embodiments, a "structural surface" 90 is any ferromagnetic material surface capable of supporting the weight of the tool holder 10 with multiple hex keys 80 inserted therein.

In another alternative embodiment, as depicted in FIG. 2 the channel 44 is deep enough to intersect each of the plurality of holes 30 at openings 48 in the tool body 12. The opening 48 is at the bottom of the channel 46 and allows the spring element to provide a contact pressure upon the bottom 46 of the channel 44 and to provide a contact pressure upon any hex key inserted within the corresponding size hole 30.

Figure 6A:
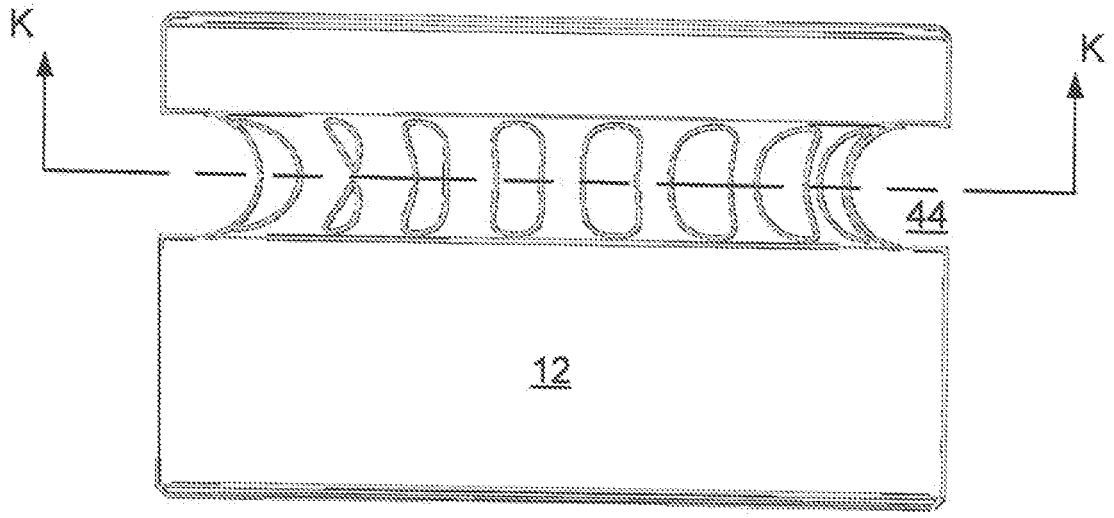
FIG. 6A is a side view of a prior art hex key.
Figure 6B:
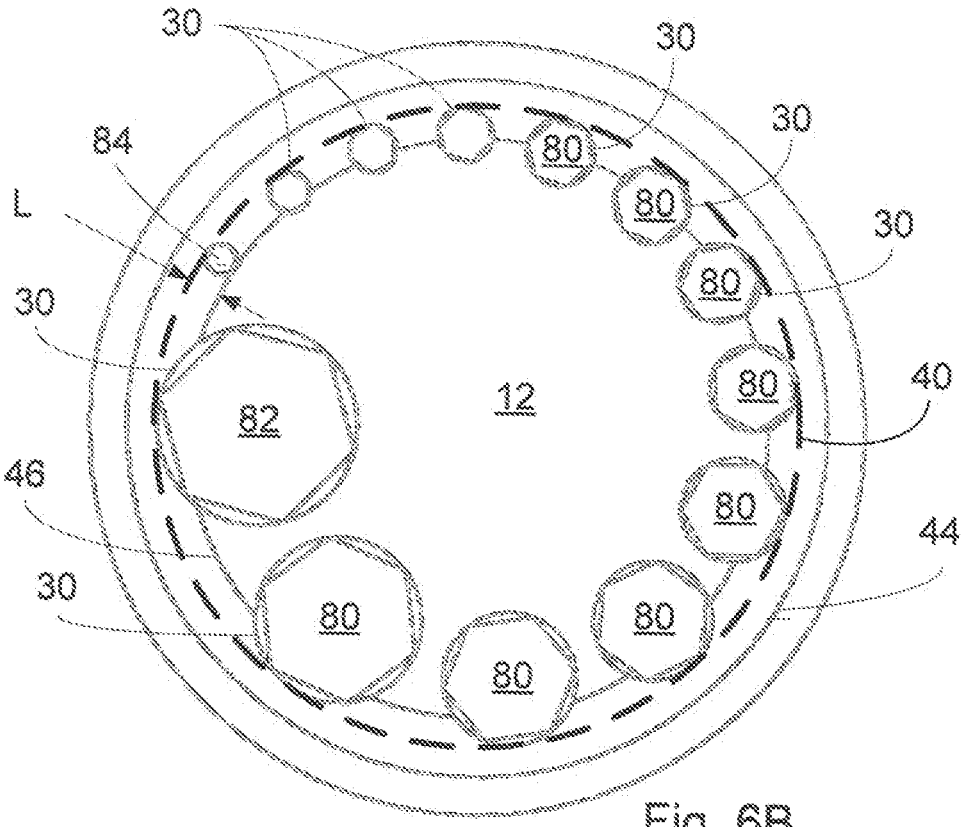
FIG. 6B is a cross-sectional view of the prior art hex key holder of FIG. 6A.

A cross-sectional cut line "K-K" thru the tool body of a prior art hex key holder design is depicted in FIG. 6A. The resulting prior art design cross-sectional view is depicted in FIG. 6B. In the prior art, due to the positioning of the holes 30, each hex key inserted into the holder body 12 displaces the spring element 40 away from the channel floor 46 by a constant amount "L". The spring element is depicted by heavy dashed line 40. This is not optimal. In the prior art designs, the largest hex key 82 only partially deflects the spring element by an amount much smaller than the diameter of the largest hex key 82. However, the smallest hex key 84 fully deflects the spring element by an amount almost equal to the diameter of the small hex key 84. This makes the smallest hex key 84 have a disproportional high force of insertion into and extraction from the hex key tool holder 10 compared to the small size and weight of the small hex key. A similar disproportionate force of insertion and retraction problem varies with the range of hex key sizes within the hex key tool holder 10.

Figure 6C:
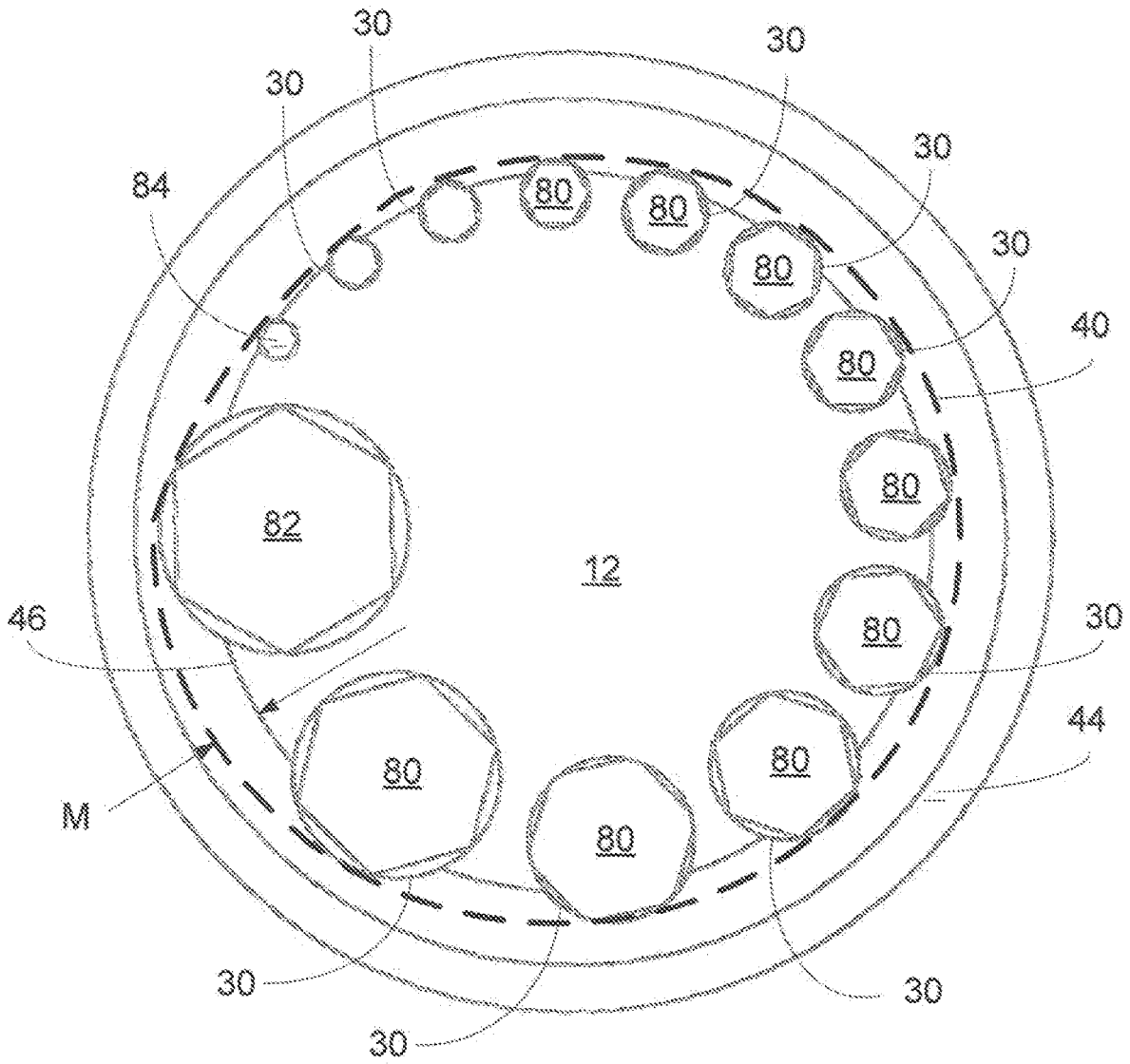
FIG. 6C is a cross-sectional view of one embodiment of the hex key holder of the present invention.

In another alternative embodiment of the present invention as depicted in FIG. 6C, the spring element 40 is displaced away from the channel floor 46 by a portion of the hex key 80 proportionate to the hex key size. The spring element is depicted by heavy dashed line 40. Stated another way, each hole 30 is positioned such that the spring element 40 is displaced away from the channel floor 46 at each opening 48 a varying distance "M." At each hole 30 with inserted hex key 80, the distance "M" is a constant, or near constant, percentage of each inserted nominal hex key 80 size. In this manner the extraction and insertion force required for each hex key 80 is proportionate to each hex key size. The distance "M" the spring is defected at each hole 30 with inserted hex key 80 will decrease as the nominal hex key sizes decrease around the holder body 12. As depicted in FIG. 6C, the centerline of each hole 30 is positioned such that the outer diameter of the hole 30 pierces the channel floor 46 and an inserted hex key 80, 82, or 84 will displace the spring element 40 above the channel floor 46 by an amount equal to 30% of the nominal hex key size. In other alternative embodiments, the friction between the material of the holder body 12 and spring element 40 against each hex key 80 may require a different maximum displacement of the spring element 40 in the range of 10% to 70% of the nominal hex key size. As will be appreciated by those skilled in the art, the maximum displacement of the spring element 40 at each inserted hex key 80 will vary slightly with the orientation of each hexagonal cross-section of the inserted hex key.

In another alternative embodiment of the present invention, the holder body 12 is formed from an elastic material to include vinyl, urethane rubber, natural rubber, polypropylene, polyethylene, or any combination thereof. The holes 30 to accept each standard key 80 are formed undersized when compared to the maximum diameter dimension of the shank of the corresponding standard hex key 80. When a hex key 80 is inserted, the holder body 12 deforms slightly and clamps the hex key 80 positively in position. As in prior embodiments, magnets 60, 70 are positioned adjacent the lower surface 22 and or sidewall 24 in any combination. The tool holder 10 is then utilized as in prior embodiments. As will be appreciated by those skilled in the art, in this and all other embodiments, the magnets 60, 70 may be molded within the tool holder body 12 during any molding process forming the tool holder body 12, may be bonded to the holder body 12 by adhesives, retained by a mechanical fastener, or any combination thereof.

As will be appreciated by those skilled in the art, in any embodiment herein the magnets 60, 70 may be a permanent magnet comprised of neodymium iron boron (NdFeB), samarium cobalt (SmCo), alnico, ceramic or ferrite, or any combination thereof. As will also be appreciated by those skilled in the art, in any embodiment herein the magnets 60, 70 may be affixed to the tool holder body 12 by; a threaded fastener, by an adhesive bond, by a press fit within the holder body, by molding in place within the holder body, or by any combination thereof. As will also be appreciated by those skilled in the art, in any embodiment herein, the holder body 12 may be formed from; aluminum, bronze, brass, plastic, acrylic, vinyl, urethane rubber, natural rubber, polypropylene, polyethylene, or any combination thereof.

While there has been shown a preferred embodiment of the present invention, it is to be understood that certain changes may be made in the forms and arrangement of the elements of the apparatus of the hex key tool holder without departing from the underlying spirit, scope, and essential characteristics of the invention. The present embodiment is therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A hex key holder; the holder comprising:

a holder body, the holder body comprising an upper surface and a lower surface joined by a sidewall;

a plurality of varying size holes extending from the upper surface to the lower surface through the holder body; each hole having a diameter to accommodate a standard hex key therein;

a recessed channel extending into the periphery of the holder body sidewall; the recessed channel comprising a channel floor at the bottom of the recessed channel; the recess channel floor extending into the holder body and intersecting each of the plurality of holes;

an elastic element positioned within the channel and sized to exert a contact pressure upon the recessed channel floor;

at least one magnet affixed to the holder body; and wherein a plurality of hex keys positioned within the holder body in a hole accommodating the hex key size, the plurality of holes positioned such that the elastic element is deflected off the channel floor a distance proportional to the nominal size an inserted hex key, the hex keys clamped in position by the elastic element, and the hex key holder may be adhered to a structural surface comprising ferromagnetic material by the at least one magnet.

2. The hex key holder of claim 1, wherein the at least one magnet is affixed in position to the holder body adjacent the holder body lower surface.

3. The hex key holder of claim 2, wherein the holder body lower surface may be positioned onto a structural surface comprising ferromagnetic material; the at least one magnet adhering the holder body in place to the ferromagnetic material structural surface; and wherein a plurality of hex keys inserted within the hex key holder and bottomed upon the ferromagnetic material structural surface; the amount of projection of each hex key above the holder body providing a ready visual reference as to the size of the each hex key.

4. The hex key holder of claim 1, wherein the at least one magnet is affixed in position to the holder body adjacent the holder body sidewall.

5. The hex key holder of claim 4, wherein the holder body sidewall may be positioned adjacent a structural surface comprising ferromagnetic material; the at least one magnet adhering the holder body in place to the ferromagnetic material structural surface; and wherein a plurality of hex keys inserted within the hex key holder and bottomed upon the holder body upper surface; the amount of projection each hex key below the holder body providing a ready visual reference as to the size of the each hex key.

6. The hex key holder of claim 1, wherein the at least one magnet is a permanent magnet comprised of neodymium iron boron (NdFeB), samarium cobalt (SmCo), alnico, ceramic or ferrite, or any combination thereof.

7. The hex key holder of claim 1, wherein the at least one magnet is affixed in position to the holder body by an adhesive bond, by a press fit within a recess in the holder body, by a threaded fastener, by molding the magnet in place within the holder body, or by any combination thereof.

8. The hex key holder of claim 1, wherein the elastic element is a coil spring.

9. The hex key holder of claim 1, wherein the elastic element is an elastic band.

10. The hex key holder of claim 1, wherein the holder body is comprised of; aluminum, brass, bronze, plastic, acrylic, vinyl, urethane rubber, natural rubber, polypropylene, polyethylene, or any combination thereof.

11. The hex key holder of claim 1, wherein the standard hex key size accommodated by each hole is marked upon the holder upper surface adjacent to each of the plurality of holes.

12. The hex key holder of claim 1, wherein the standard hex key size accommodated by each hole is embossed upon the holder upper surface adjacent to each of the plurality of holes.

13. The hex key holder of claim 1, wherein the standard hex key size accommodated by each hole is engraved into the holder upper surface adjacent to each of the plurality of holes.

14. A hex key holder; the holder comprising;

a holder body, the holder body comprising an upper surface and a lower surface joined by a sidewall;

a plurality of varying size holes extending from the upper surface to the lower surface through the holder body; each hole having a diameter to accommodate a standard hex key therein;

the holder body comprised of an elastic material; the diameter of each hole capable of deforming to accept and retain a standard hex key therein;

at least one magnet affixed to the holder body; and wherein, a plurality of hex keys positioned within the holder body in a hole accommodating the hex key size are clamped in position by the deformation of the elastic holder body material and the hex key holder may be adhered to a structural surface comprising ferromagnetic material by the at least one magnet.

15. The hex key holder of claim 14, wherein at least one magnet is affixed in position within the holder body adjacent the lower surface.

16. The hex key holder of claim 15, wherein the holder body lower surface may be positioned onto a structural surface comprising ferromagnetic material; the at least one magnet adhering the holder body in place to the ferromagnetic material structural surface; and wherein a plurality of hex keys inserted within the hex key holder and bottomed upon the structural surface comprising ferromagnetic material; the amount of projection each hex key above the holder body providing a ready visual reference as to the size of the each hex key.

17. The hex key holder of claim 14, wherein at least one magnet is affixed in position within the holder body adjacent the sidewall.

18. The hex key holder of claim 17, wherein the holder body sidewall may be positioned adjacent a to structural surface comprising ferromagnetic material; the at least one magnet adhering the holder body in place to the ferromagnetic material structural surface; and wherein a plurality of hex keys inserted within the hex key holder and bottomed upon the holder body upper surface; the amount of projection each hex key below the holder body providing a ready visual reference as to the size of the each hex key.

19. The hex key holder of claim 14, wherein the at least one magnet is molded in position within the holder body.

20. The hex key holder of claim 14, wherein the at least one magnet is affixed in position to the holder body by a press fit within a recess in the holder body.

21. The hex key holder of claim 14, wherein the elastic material of the holder body comprises; plastic, vinyl, acrylic, urethane rubber, natural rubber, polypropylene, polyethylene, or any combination thereof.

22. A hex key holder; the holder comprising:

a holder body, the holder body comprising an upper surface and a lower surface joined by a sidewall;

a plurality of varying size holes extending from the upper surface to the lower surface through the holder body; each hole having a diameter to accommodate a standard hex key therein;

a recessed channel extending into the periphery of the holder body sidewall; the recessed channel comprising a channel floor at the bottom of the recessed channel; the recess channel floor extending into the holder body and intersecting each of the plurality of holes;

an elastic element positioned within the channel and sized to exert a contact pressure upon the recessed channel floor;

the plurality of holes positioned such that the elastic element is deflected off the channel floor a distance proportional to the nominal size an inserted hex key;

at least one magnet affixed to the holder body; and wherein a plurality of hex keys positioned within the holder body in a hole accommodating the hex key size, each hex key is clamped in position by the elastic element with a clamping force proportional to the hex key size, and the hex key holder may be adhered to a structural surface comprising ferromagnetic material by the at least one magnet.

23. The hex key holder of claim 22, wherein the elastic element is deflected off the channel floor a varying distance within the range of 10% to 70% of the nominal size each inserted hex key and producing a clamping force proportional to the hex key size.

* * * * *